US007333231B2

(12) United States Patent
van der Meer et al.

(10) Patent No.: US 7,333,231 B2
(45) Date of Patent: Feb. 19, 2008

(54) METHOD AND SYSTEM FOR GENERATING AND FINISHING DOCUMENTS

(75) Inventors: Hendrik Theodorus van der Meer, Drachten (NL); Bertus Karel Edens, Drachten (NL)

(73) Assignee: Neopost B.V., Drachten (NL)

( * ) Notice: Subject to any disclaimer, the term of this patent is extended or adjusted under 35 U.S.C. 154(b) by 288 days.

(21) Appl. No.: 10/788,443

(22) Filed: Mar. 1, 2004

(65) Prior Publication Data

US 2004/0168125 A1 Aug. 26, 2004

Related U.S. Application Data

(63) Continuation of application No. 09/475,076, filed on Dec. 30, 1999, now abandoned.

(30) Foreign Application Priority Data

Dec. 31, 1998 (NL) ..... 1010936

(51) Int. Cl.
*G06F 15/00* (2006.01)
*H04N 1/21* (2006.01)

(52) U.S. Cl. ..... 358/1.15; 358/1.15; 358/296; 358/401

(58) Field of Classification Search ..... 358/1.1, 358/1.11–1.18, 1.9, 296, 401
See application file for complete search history.

(56) References Cited

U.S. PATENT DOCUMENTS 5,245,545 A * 9/1993 Taylor ..... 700/219
5,283,752 A * 2/1994 Gombault et al. ..... 700/221
5,615,015 A * 3/1997 Krist et al. ..... 358/296
5,628,249 A 5/1997 Cordery et al.
5,726,897 A 3/1998 Tammi et al.

(Continued)

FOREIGN PATENT DOCUMENTS

EP 0 265 192 A2 4/1988

(Continued)

OTHER PUBLICATIONS

"PostScript Language Document Structuring Conventions Specification," *Adobe Developer Support*, Version 3.0, Adobe Systems Incorporation, Sep. 25, 1992.

*Primary Examiner*—Gabriel Garcia
*Assistant Examiner*—Thierry L. Pham
(74) *Attorney, Agent, or Firm*—Buchanan Ingersoll & Rooney PC

(57) ABSTRACT

For generating and finishing documents, a first data file in a first format, which describes the content of a document, is provided. The first data file is converted into a second data file (21-25; 121-125) in a second format, in which image defining instructions and other instructions for finishing the document occur. The second data file (21-25; 121-125) is processed into a processed second data file (21-25) with driving instructions for generating documents and associated driving instructions for finishing documents. Thereafter, in accordance with the driving instructions, a document is generated and finished in accordance with the driving instructions. Also disclosed are a system and a program structure for carrying out the proposed method. A considerable saving on the variety of software required for operating different operating systems and kinds of equipment is feasible, while information concerning the image such as it has been created in composing the document is maintained.

29 Claims, 2 Drawing Sheets

U.S. PATENT DOCUMENTS

| | | | | |
|---|---|---|---|---|
| 5,777,882 | A * | 7/1998 | Salgado | 700/214 |
| 5,899,990 | A * | 5/1999 | Maritzen et al. | 707/4 |
| 6,393,135 | B1 * | 5/2002 | Girardi et al. | 382/101 |
| 6,707,568 | B1 | 3/2004 | Yu | |

FOREIGN PATENT DOCUMENTS

| | | | |
|---|---|---|---|
| EP | 0 376 467 | A1 | 7/1990 |
| EP | 0 628 357 | A1 | 12/1994 |
| EP | 628357 | A1 * | 12/1994 |
| EP | 0 678 346 | A2 | 10/1995 |
| EP | 0 719 597 | A2 | 7/1996 |
| EP | 0 851 365 | A1 | 7/1998 |
| EP | 0 974 914 | A2 | 1/2000 |
| EP | 0 974 915 | A2 | 1/2000 |
| GB | 2 202 660 | A | 9/1988 |
| NL | 8901557 | | 1/1991 |
| WO | WO 97/28972 | A1 | 8/1997 |

* cited by examiner

METHOD AND SYSTEM FOR GENERATING AND FINISHING DOCUMENTS

This application is a continuation of application Ser. No. 09/475,076 filed on Dec. 30, 1999 now abandoned.

FIELD AND BACKGROUND OF THE INVENTION

This invention relates to a method and a system for generating and finishing documents.

To effectively communicate by way of documents, it generally does not suffice to compose a document, but it is to be ensured that the document reaches the person for whom the document is intended in a useful form.

When the document is a letter, for instance, it needs to be prepared for dispatch after being printed, for instance by folding the document and inserting it in an envelope. However, the document may also be a report or brochure, the pages of which are to be gathered and bound with a cover. Even if the document is an electronic document, some extent of finishing will be required to bring the document in a form suitable for transmittal and to provide it with an address.

For the dispatch of physical documents, and in particular postal items, it used to be, and still is, conventional to print indicia on a main document, which indicia represent finishing instructions, or refer to an address where finishing instructions are stored. When a package of main documents has been printed, these are transferred to an inserter system in which the indicia are read and the main documents are processed in accordance with the indicia. Examples of this are described in British patent application 2,202,660 and European patent application 0,265,192.

To avoid the necessity of printing indicia on main documents, U.S. Pat. No. 5,283,752 proposes to feed documents directly from a printing apparatus to a finishing apparatus. The instructions for printing the documents and the instructions for finishing the documents are sent out as a coherent set of instructions. Since in this way the order in which instructions are sent out is coupled to the order in which the documents are supplied to be finished, the printing of indicia for controlling the finishing of the documents can be omitted. More recent examples of integration of the printing and finishing of documents are described in U.S. Pat. No. 5,628,249 and in international patent application WO 97/28972.

A problem with the integrated composition of instructions for printing and finishing documents is that if data processor systems from which the instructions for generating and printing documents are sent out work under different operating systems, different driving programs (drivers) which are designed to work under those different operating systems are needed. Also when newer versions of operating systems are installed, in many cases new versions of the driver programs are needed. Further, different driver programs are needed for driving different finishing apparatuses, while the large number of variants and configurations in which finishing equipment is available further enlarge the required variety of driver programs. Especially if it is desired to enable a large number of users to generate and finish documents by means of different apparatuses, this renders system management complicated. If it is also desired to process the instructions for generating and finishing documents, a further problem resides in the fact that many variants of the software for processing the instructions for generating and finishing documents will be needed as well, and when new versions of operating systems appear, updated versions will be necessary in many cases.

SUMMARY OF THE INVENTION

It is an object of the present invention to limit the required variety of driver software needed to control the generation and finishing of documents, given a particular variety of operating systems and/or finishing equipment, all this while maintaining manageability of document images obtained using known driver software, This object is achieved according to the present invention with a method for generating and finishing documents, having the following operations: providing a first data file in at least one first format, which data file describes the content of at least one document; converting the first data file in the first format into a second data file in a second format, comprising image defining instructions and other instructions for finishing the at least one document; processing the second data file into a processed second data file, whereby the image defining instructions are processed into driving instructions for generating at least one document and whereby the other instructions for finishing the at least one document are processed into driving instructions for finishing the at least one document; thereafter driving equipment for generating and finishing the at least one document in accordance with the driving instructions; and generating and finishing at least one document by means of the equipment in accordance with the driving instructions.

For this purpose, the invention further provides a system for generating and finishing documents, having: a data processor structure and equipment for generating and finishing documents, the data processor structure being arranged for: providing a first data file in at least one first format, for describing the content of documents; converting the first data file in the first format into a second data file in a second format, comprising image defining instructions and other instructions for finishing the at least one document; and processing the second data file into a processed second data file, whereby the image defining instructions are processed into driving instructions for generating at least one document and whereby the other instructions for finishing the at least one document are processed into driving instructions for finishing the at least one document; wherein the data processor structure and the equipment for generating and finishing documents are operatively connected for driving the equipment for generating and finishing documents in accordance with driving instructions from the processed second data file; and wherein the equipment for generating and finishing documents is arranged for generating and finishing documents in accordance with the driving instructions.

The invention further provides a computer program structure having: instructions for converting a first data file in a first format for describing the content of at least one document into a second data file in a second format, comprising image defining instructions and other instructions for finishing the at least one document; and instructions for processing the second data file into a processed second data file, whereby the image defining instructions are processed into driving instructions for generating at least one document and whereby the other instructions for finishing the at least one document are processed into driving instructions for finishing the at least one document.

Such a system and such a computer program structure are specifically arranged for carrying out the method according to the invention. The computer program structure can be, for instance, in the form of an installation program which after installation on one or more computers exhibits the features described, of one or more programs installed in a computer system and/or of an array of instructions wholly or partly permanently stored in integrated circuits.

Because the information that describes the finishing instructions of one or more documents, after the finishing instructions have been converted into a second format, is processed into a modified data file before the driving instructions based thereon are transmitted, instructions which have been composed under different operating systems can be processed with a single common processing program, for instance to verify the correctness of addresses. This program can further be used to process the instructions for different kinds of peripheral equipment, so that one version of the processing program is suitable for processing instructions for apparatuses of different types. This yields a considerable saving on the variety of software needed for operating different operating systems and apparatuses.

Because the second format contains image defining instructions, it is through the conversion of the instructions from the first format to the second format that the image or the images of which the document or the documents will consist is or are recorded in a universal intermediate format. Information regarding the image such as it has been created in composing the document is then, at least essentially, maintained, so that a "What you see is what you get"—like manageability of the image, which is conventional in document-generating software, can be maintained. In addition, of course, it is also possible, when processing the second format, to deliberately make changes to the image or the images.

A further advantage of the method according to the invention is that in driving different peripheral equipment for generating and finishing documents within an organization, the users need to familiarize themselves only with one interface to be able to generate and finish documents from different apparatuses, and system management is simplified because when the array of equipment to be driven for generating and finishing documents is modified, this does not require a corresponding number of modifications of driving software installed with users.

The documents can be both physical documents and electronic documents. The finishing of the documents can take many forms, such as the packaging in an envelope, the binding of pages belonging to each other, or driving an e-mail program in accordance with address data associated with an addressee with addition of inserts specified in drafting the document. The other instructions for finishing the document or the documents can consist not only of instructions as such, but also of a reference to a set of instructions, such as a set of job settings. The instructions can be isolate instructions independent of the image defining instructions, but may also be partly in the form of, for instance, a series of instructions not intended for the printer or another image defining facility in, for instance, a printer language or in an XML (extended markup language) document.

Further objects, aspects, advantages and details concerning the invention appear from the dependent claims and the following description of a few exemplary embodiments, with reference to the accompanying drawings.

DETAILED DESCRIPTION

Figure 1:
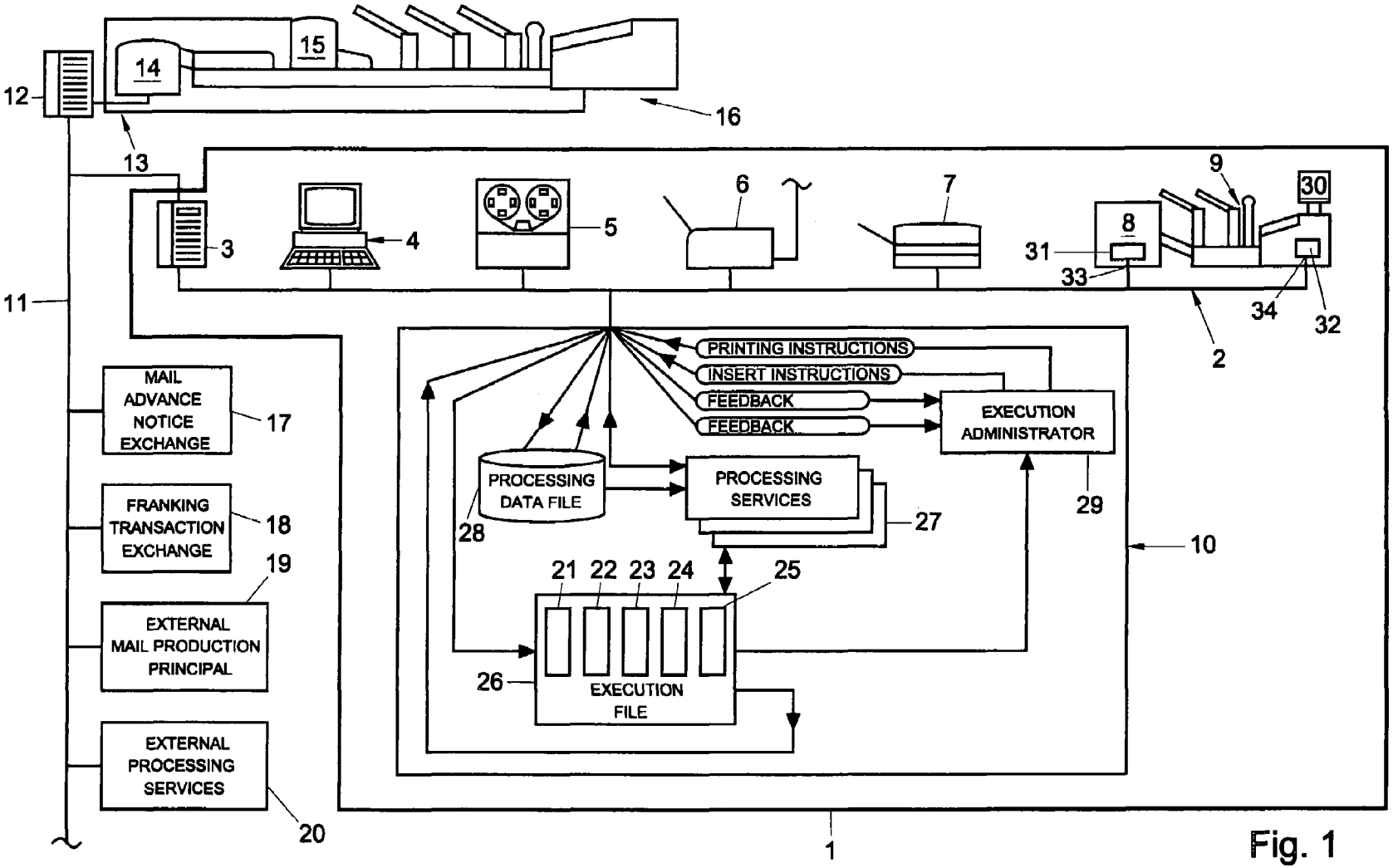
FIG. 1 is a schematic representation of a system according to a first exemplary embodiment of the invention.

The invention is first described further with reference to the example represented in FIG. 1. With a thick line, a local area 1 is framed, within which a local design of the system is located. This system comprises a local network structure 2 to which a number of stations are connected. According to this example, the connected stations are: a communication server 3, a personal computer 4, a minicomputer 5, a network fax-scanner-printer 6, a printer 7, a high-volume printer 8, an inserter system 9 and a document execution server 10.

The communication server 3 is connected via an adapter to a data transmission network 11, which can be formed, for instance, by a telephone network, a glass fiber network or a coaxial cable network, which may or may not be supplemented with networks connected thereto.

Connected to this data transmission network 11 is a communication and document execution server 12, which in turn is connected via a local network 13 to inter alia a printer 14 for printing main documents, a printer 15 for printing inserts, and an inserter system 16 for packaging documents coming from the printing apparatuses 14, 15.

Further connected to the data transmission network 11 are: a mail advance notice exchange 17, to which messages concerning mailings to be sent can be reported, so that the mail can take this into account in planning the sorting and distribution capacity, a franking transaction exchange 18 for settling frankings, an external mail production principal 19 (for instance an associate company which does not have facilities for the integrated generation and finishing of documents) and a server 20 designed with external processing services as an alternative to and in supplementation of internal processing services which will be discussed hereinafter.

The local data processor structure and equipment for generating and finishing documents at location 1 consists, according to this example, of the personal computer 4 (in practice, generally, a plurality of those are connected to the network 2), the minicomputer 5 and the document execution server 10.

Of this data processor structure, the personal computer 4 and the minicomputer 5 are each arranged for providing a first data file in at least one first format, for describing the content of one or more documents. In the personal computer 4, this has been achieved, in this example, in that a current word processing program with a mail merge facility has been installed thereon and in the minicomputer 5 this has been achieved, in this example, in that a data file program has been installed thereon with a facility for generating standard correspondence associated with particular situations of entities occurring in an information file. This can be, for instance, a program which generates bank statements in response to a particular transaction sum or a particular number of transactions being reached. Further, on the computer systems 4, 5, current operating systems for such computers have been installed, to which the word processing and data file applications have been tailored. Such operating systems are generally known and commercially available, at least licensable, in different forms.

The computers 4, 5 further each comprise a driving program (driver) for converting the first data file in the first format into a second data file in a second format which contains image defining instructions. As second format, according to this example, a Postscript (registered trademark of Adobe Systems Inc.) format is used. In this printer language, the image defining instructions comprise separately executable sets of image defining instructions each comprising image defining instructions for printing an individual page. This makes it possible to print pages independently of each other in a random order and on different printing apparatuses. It is also possible, however, to use other formats, such as a PCL format or a bit-map format.

The use of a printer language as second format for the instructions provides the advantage that these, especially for word documents, form image defining instructions on the basis of which images of a very high resolution can be formed (and hence are also suitable as a basis for reproductions with a less high resolution) and that these are generally very common, so that driving software for a large number of operating systems is supported. Finishing instructions can, for instance, be included in the second format as extensions of the printer language. For further details regarding the addition of extensions, reference is made to specifications regarding the printer language in question.

The document execution server 10 is arranged for processing the second data file into a processed second data file comprising driving instructions for generating documents and associated driving instructions for finishing documents. To that end, the document execution server 10, according to this example, is arranged for receiving data files 21-25 in an execution file 26. Further, the document execution server 10 is designed with software in the form of processing services 27 which, depending on the need of the user of the system, can offer various facilities, for instance by installing various program modules or not.

These processing services 27 can, for instance, provide for the determination of a franking value, the entering into franking transactions with the franking transaction exchange 18, the determination of franking instructions, and the corresponding processing of data files in the execution file.

Other processing services relating to finishing instructions are, for instance: providing for insert instructions for the inserter system 9 in accordance with the instructions in the respective data file 21-25 and data present in a processing data file 28 concerning insert feeders in which the inserts in question are located or data concerning respective inserts associated with particular categories of documents.

The installed processing services 27 can further be designed for selecting equipment for generating and finishing documents and, if necessary, for converting the instructions for generating and finishing documents to a format suitable for the selected apparatus or the selected apparatuses. Thus, the user does not need to concern himself with the choice of an apparatus for documents to be generated and finished. This is advantageous in particular if, as with the proposed system, the equipment for generating and finishing documents comprises equipment for generating and finishing physical documents and equipment for generating and finishing electronic documents. The transmittal of physical and electronic documents can then proceed via common operating interface. In combination with reachability data of addressees and optionally data regarding the location of addressees, the nature and urgency of documents and the costs of different transmittal possibilities, it is then possible for different transmittal options to be proposed and possibly selected automatically. Such provisions too may be part of the operating services 27.

A further processing operation for which the processing services 27 can be advantageously arranged is determining imprints on envelopes in accordance with associated image defining instructions for printing documents. This makes it possible in a simple manner to send personalized mail without use of window envelopes. Incidentally, there does not need to be a one-on-one relationship between the content of a document and the imprint on an envelope. Thus, the imprinting of envelopes can consist, for instance, in printing different logos or captions on the envelopes, for instance depending on the department of an organization with which the addressee has a relation.

The processing services 27 can further be arranged for generating associated finishing instructions in the form of composing transmittal data regarding a group of documents, for instance in accordance with a relation profile which has been established for that group of documents. The transmittal data can be determined, for instance, on the basis of data stored in the processing data file 28.

A further application for which the processing services 27 can be advantageously arranged is verifying at least a portion of the driving instructions. This can serve, for instance, to verify addresses or post codes or to check the validity or availability of specified inserts or insert files. The data on the basis of which the validation is carried out can be stored in the processing data file. Especially if processing operations that occur relatively infrequently are involved or addresses coming from extensively managed address files are involved, it may be advantageous to provide for communication between the processing service software 27 and external processing services 20 in order to carry out the intended verification.

The processing services 27 which are installed on the document execution server 10 can therefore be arranged both for adding finishing instructions and for modifying or converting finishing instructions received as part of the second data file.

The processing services can further be arranged for converting image defining instructions in a first printing language into image defining instructions in a second printing language. In this example, where the data files 21-25 come in as Postscript software, for instance a translation facility may be provided for translating Postscript into another printer language, such as PCL, or into a format in which the document can be generated as a fax message, an e-mail message or a web page on Internet or an Intranet, including addition of an address (telephone number, e-mail address, page location), and can be transmitted to the respective equipment 3, 6 for generating and finishing a document.

Other processing operations on at least a portion of the image defining instructions for which the processing services 27 can be arranged, are: reading at least portions of the image defining instructions and, in accordance with the portions read, sorting sets of the image defining instructions each associated with a particular document. This makes it possible to sort documents, for instance in a manner that yields savings on the distribution costs.

Because the data in the second format to be processed are supplied to the processing services 27 in a standardized manner, regardless of the application and the operating system under which these data have been generated, in principle only one version of these processing services needs to be developed.

The document execution server 10 is further arranged for managing communication with the equipment 3, 6, 8, 9 for generating and finishing documents, and operatively connected with that equipment 3, 6, 8, 9 via the network 2 for driving that equipment 3, 6, 8, 9 in accordance with driving instructions from the processed second data file. To that end, the document execution server 10 comprises execution administrator software 29.

The equipment 3, 6, 8, 9 for generating and finishing documents is arranged for generating and finishing documents in accordance with the driving instructions. In this example, the communication server 3 is arranged for transmitting instructions regarding documents to be generated and finished elsewhere, the generation of e-mail messages, as well as web pages for Internet and Intranet applications in accordance with instructions generated by the execution administrator software 29. According to this example, the processing services 27 are further arranged for transmitting second data files, rather than transferring them to its own execution administrator software 29, to an external execution administrator which may be installed, for instance, in the server 12. This can be advantageous, for instance, if the printing and inserting equipment 14-16 which is driven by that server 12 is located closer to addressees or is exclusively then (better) suited for printing and finishing the documents in question, In general, it is preferred to send the instructions in the unprocessed or only partly processed second format, so that location-dependent processing operations can be carried out starting from this universal format.

Further, in this example, the fax machine 6 is arranged for sending fax messages in accordance with instructions generated by the execution administrator software 29. Finally, the printing apparatus 8 and the inserter system 9 are each separately connected to the document execution server 10 via the network 2.

The inserter system 9 is arranged in-line with the printing apparatus 8 for finishing documents received directly from the printing apparatus. This makes it possible to generate and finish documents without manual intervention.

The printing apparatus 8 and the inserter system 9 each have their own control unit 31, 32. This makes it possible, in the first place, to have the two apparatuses 8, 9 work separately from each other. As a consequence, for instance the printing apparatus 8 is available for other tasks if the inserter system 9 is being employed for packaging documents already printed earlier. It further creates the possibility of combining different inserter systems 9 with different printing apparatuses 8, insofar as the drive is supported by the conversion possibilities of the processing services 27. Thus, in a simple manner, the possibility is obtained of combining a large variety of printing apparatuses and inserter systems with each other. In particular, this provides the advantage that on the one hand, in many cases, equipment already available can be integrated into the proposed system and, on the other, relatively little effort is required to ensure that upon installation of a new system or replacement of printing equipment, in each case very recent models can be fitted in.

To enable different printing apparatuses 8 and inserter systems 9 to be used independently of each other, it is further advantageous that the control units 31, 32 each have their own port 33, 34 for communication with an external data processor.

The inserter system 9 is further arranged for transmitting processing capacity-representing signals to the document execution server 10, and the document execution server 10 is arranged for driving the printing apparatus 8 in response to those processing capacity-representing signals, for printing at least one next document. By carrying out the supply of driving instructions to the printing apparatus 8 in accordance with processing capacity-representing signals coming from the system 9 for finishing documents, it can be ensured in a simple manner that the amount of printing instructions in the memory of the printing apparatus remains within particular limits. This in turn is advantageous because the number of documents being processed during an instance of failure then remains limited, which simplifies resumption of the generation and finishing of documents without loss or duplications ("job recovery"). The processing capacity-representing signals are represented in the drawing as arrows designated "feedback".

The execution administrator software 29 is arranged for managing separate communication with the printing apparatus 8 and the inserter system 9, while coordination between the printing and the finishing operations to be carried out takes place on the basis of information regarding the number of associated sheets per set coming from the printing apparatus 8 and numbers of arrived sheets detected by the inserter system 9. The inserter system 9, incidentally, comprises a second printing apparatus 30, with which inter alia addresses, logos and franking indicia can be printed on envelopes.

The data processor structure which, in this example, is intended for the management of the generation and finishing of documents is divided over first data processor stations—formed by the personal computer 4 or the minicomputer 5, depending on the source from which the data regarding the documents to be generated and finished are composed—and a second data processor station in the form of the document execution server 10, which data processor stations are mutually coupled via the network 2 for transferring data from the first data processor station to the second data processor station. Through the division of applications for generating or at least inspecting information and drivers on the first data processor stations 4, 5 and software for processing and executing instructions in the second format on the document execution server 10 associated therewith, the processing services 27 need to be installed exclusively on the document execution server 10, which is highly advantageous from the viewpoint of simplification of system management. On the first data processor stations 4, 5 of users who are designated to generate and issue documents—of whom typically a large number are present in an organization—it is merely necessary, in the use of this example, to install only a driver compliant with the operating system in question.

In operation, generating and finishing documents according to this example proceeds as follows:

A first data file is provided in a first format, which will generally be application-specific. This data file describes the content of a document or several documents.

The first data file is processed into a second data file in a second format. This second data file contains image defining instructions, so that information which defines images which have been created during the making of the document or the documents is maintained. For processing the first data file into a second data file, from the application a driver software is activated, which, after being activated, first offers options regarding finishing possibilities. These options can comprise both direct designation of finishing instructions and designation of processing services which subsequently result in (further) finishing instructions.

The second data file is processed, in accordance with the choices made, into a processed second data file with driving instructions for generating documents and associated driving instructions for finishing documents. This processing can take different forms, as appears from the above description. In outline, the following can be distinguished: substance modification, such as addition or alteration, of image defining instructions and/or finishing instructions and converting instructions to a different format to enable communication with a specific apparatus. The processing operations can be executed while the second data file remains in a temporary storage for document generation and finishing instructions ("spooler").

Next, in accordance with the driving instructions, the equipment 3, 6, 8, 9, 14-16 is driven for generating and finishing documents and the documents are generated and finished by the driven equipment in accordance with those driving instructions.

The above-described advantage that the method can be utilized, with little variety of software, on a wide range of operating systems and equipment for generating and finishing documents is especially advantageous when applications are involved where the driving instructions for generating documents form instructions for printing documents and are fed to a printing apparatus, and where the driving instructions for finishing documents form instructions for processing physical documents printed by the printing apparatus and are fed to a system for finishing physical documents, which system finishes documents printed by the printing apparatus in accordance with the instructions for finishing physical documents. Apparatuses for finishing physical documents, such as inserter machines and binding machines, are manufactured in relatively small numbers, so that the costs of developing variants of driver software constitute a comparatively large proportion of the costs of such equipment. Further, in many cases, it is desirable that such apparatuses can be used in combination with different high-volume printing apparatuses.

Further, in use, the documents can be fed directly from the printing apparatuses 8, 14, 15 to the system 9, 16, for finishing documents. As a consequence, the chances of the occurrence of irregularities in transferring the documents are limited. Further, in many cases, less stringent requirements need to be imposed on the processing speeds of the inserter system, because the finishing of the documents does not need to be deferred until a package of documents is ready to be transferred to the inserter system.

For managing the document stream, it is then advantageous if the documents are fed one by one from the printing apparatus 8 to the system 9 for finishing documents. If the printing apparatus has facilities for gathering printed documents into stacks and feeding those stacks, it is also possible, however, to provide that documents are fed stack by stack directly to the finishing system, for instance in the form of stacks of two or more mutually associated documents which are to be bound together, or packaged together in an envelope.

Figure 2:
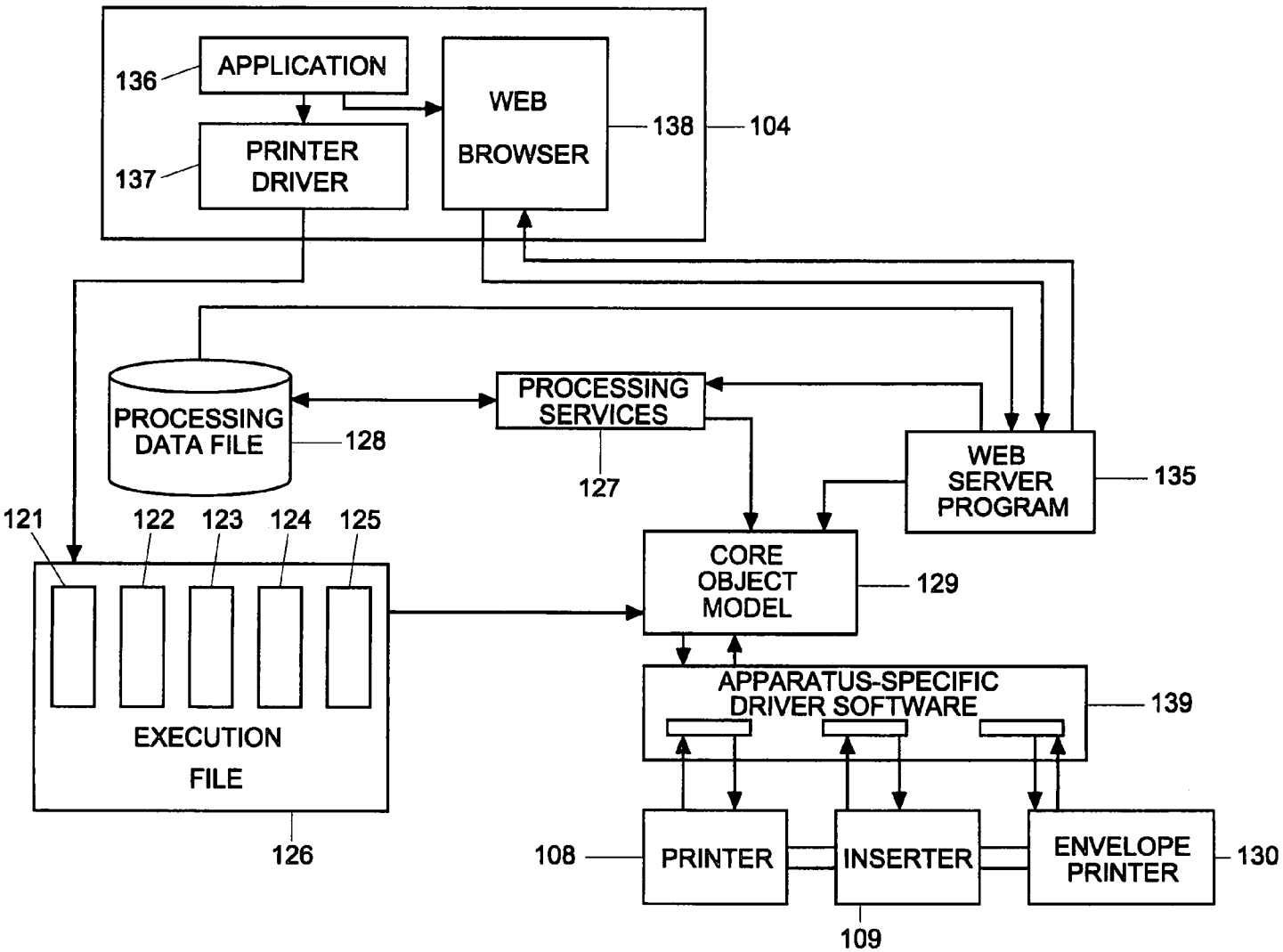
FIG. 2 is a schematic representation of the architecture of a part of a system according to a second exemplary embodiment of the invention.

In FIG. 2 an example is represented of an architecture with which further savings on the required variants of software can be achieved. Instead of an adapted driver, a standard driving program ("printer driver") 137 is used for processing the first data file in a format associated with an application 136 (such as a word processing program or a database program with a document composition facility), into a second data file 121-125, which is sent to a execution data file 126, such as a spooler. Here, too, advantageously a Postscript driver 137 can be used, because this enables page-by-page execution in a random order.

For inputting the finishing instructions and communication regarding the status of a series of documents to be generated and finished, however, use is made of universal client-server operating interface software which is preferably interactive. According to this example, a host portion thereof is installed on a web server 135 and cooperates with a client portion 138 which is installed on a client system 104. This client portion, in this example, is formed by web browser software 138. Via a suitably arranged page on the web server 135, finishing instructions and processing services 127 can be selected and set. According to this example, for the functions to be operated directly, of a system for finishing documents, a web page is used which represents a virtual control panel of a system for finishing documents.

The second data files 121-125 are received from the execution file 126 as objects into a core 129 of an object model which contains commands to generate and process documents in the form of the above-discussed second data files, data regarding the order of exit of documents and series of mutually associated documents, data regarding processing options and, if applicable, error reports. Layers around it are formed by software, such as the processing services 127, the processing data file 128 and equipment-specific driver software 139 to drive equipment in accordance with instructions determined in the core 129. In accordance with options inputted through the web browser software 138, from the web server 135, image defining instructions and finishing instructions are received as objects in the object model. The processing services 127 which have been designated by the web server software process the instructions inputted into the object model, into a processed second data file. In accordance therewith, the apparatus-specific driver software 139 next provides for the drive of the equipment 108, 109, 130 for generating and finishing documents. The sequences and speeds of transmission of driving instructions for printing the documents and of the driving instructions for managing the finishing of printed documents are adjusted to each other and to readiness or availability signals received from the equipment 108, 109, and 130.

Because the instructions for processing the second data file into the processed second data file are inputted utilizing a universal server-client interface, and such universal interfaces are available for many operating systems and are developed for new operating systems, the accessibility of the system for inputting finishing instructions and the specification of processing services for a large variety of operating systems can be ensured, without requiring development of different designs of a special operating interface associated with the finishing equipment, for different operating systems.

The universal interface can moreover be simply arranged for offering access to information about the results of the command to generate and finish files, the status regarding the execution of a particular command, and the expected time of completion of a command. To that end, for instance, instruments conventional for generating and composing web pages, such as html formats and software known by the name of Java, can be utilized.

Because the second data file prior to being processed is free of finishing instructions, also on the side of the processing of information into a format associated with the application into a second data file with image defining driving information, no specific software for this application is needed. Use can be made of driving software for, for instance, printing apparatuses which are offered in general for a large variety of operating systems by manufacturers of printing apparatuses. As it is not necessary to process finishing instructions into the second data file, it is moreover better possible to use, as a second data file, if desired, other formats than Postscript, such as PCL files or flat ASCII files.

In the use of the proposed software on a network, a further important advantage is that software specifically intended for the integrated generation and finishing of documents only needs to be installed on the document execution server, which is highly advantageous from the point of view of system management simplification. Updating the software specific for the integrated generation and finishing of documents, for instance because of a new version becoming available or the addition or removal of functional modules, only needs to be done on the server 135. In a simple manner, users can be informed of modifications relevant for them via the first web page they open when selecting the software for specifying finishing instructions. On client systems 104, only a universal driver program 137 and the client portion 138 of the universal interactive interface needs to be installed. The latter kind of software, for instance in the form of web browser software, in many cases belongs to the standard equipment of client systems.

If the execution file 126, the processing services 127, the processing data file 128, the core 129 of the object model and the host portion of the operating interface are installed on a system that works under a first operating system, for instance a system marketed under the trademark name of Windows NT, commands to generate and finish documents can be given from client systems which run under different other operating systems, such as driving systems, known under the names of Unix, Linux, Mac OS and OS/2, without it being necessary to develop software intended specifically for the use of the integrated generation and is finishing of documents and to adapt same to developments in the field of operating systems.

Incidentally, instead of web browser programs, different other kinds of programs can be used which are available for different operating systems, such as e-mail programs. With an e-mail program, the operation can be realized, for instance, through receipt of a specification overview with filled-in standard finishing settings and a specification of possible alternative finishing settings as well as provisions to indicate with which instructions for generating documents the finishing instructions are associated. These settings can subsequently be modified as desired, whereafter the specification overview is sent back as reply. Obviously, every user can store preferred settings as template, and dynamic finishing systems, such as addition of less urgent messages stored for transmittal to addressees, can be automatically managed via processing services.

Electronic documents and documents which are to be remotely generated and printed are generated and finished, according to this example, by transmitting documents generated with the application 136 directly to the web server. It is also possible, from the application 136, to drive a web based e-mail or fax program which is installed on the server.

It is incidentally noted that operating a printer and/or a system for finishing documents, such as an inserter system, with a universal client-server operating interface, is also advantageous outside the context of what has been proposed hereinabove, or at least parts thereof, because already by that reason such equipment can be driven from systems which can run under many different operating systems, without requiring the availability of driving software specific for the apparatus in question, working under the operating system in question, According to the present example, the processed second data file is made up of a first subfile containing image defining instructions, a second subfile containing associated finishing instructions and references that couple the image defining instructions to associated ones of the finishing instructions. Since the finishing instructions are specified separately, enter via a separate channel and are converted into separate communication streams with printing apparatuses 108, 130 and inserter systems 109, it is advantageous to keep the finishing instructions separate from the image defining instructions, also in the file on which the communication streams are based. This further provides the advantage that one is not bound to conventions concerning the format of the image defining instructions, such as a printer language.

The invention claimed is:

1. A method for generating and finishing documents, comprising:

converting a first data file in a first format, which data file describes the content of at least one document, into a second data file in a second format, comprising image defining instructions and other instructions for finishing said at least one document;

processing said second data file into a processed second data file, wherein said image defining instructions are processed into driving instructions for generating at least one document, and wherein said other instructions for finishing said at least one document are processed into driving instructions for finishing said at least one document;

thereafter driving equipment for generating and finishing said at least one document in accordance with said driving instructions; and generating and finishing at least one document by means of said equipment in accordance with said driving instructions;

wherein said driving instructions for generating documents comprise instructions for printing documents are fed to a printing apparatus, and wherein said driving instructions for finishing documents comprise instructions for finishing physical documents printed by said printing apparatus are fed, separately from said driving instructions for generating documents, to a system for finishing physical documents, and wherein documents are finished by said finishing apparatus in accordance with said instructions for finishing physical documents.

2. A method according to claim 1, wherein said image defining instructions are formed by instructions for driving a printing apparatus.

3. A method according to claim 1, wherein said documents are delivered from said printing apparatus directly to said system for finishing physical documents.

4. A method according to claim 1, wherein said documents are fed one by one from said printing apparatus to said system for finishing physical documents.

5. A method according to claim 3, wherein the supply of driving instructions to said printing apparatus is carried out in accordance with receiving capacity representing signals coming from said system for finishing physical documents.

6. A method according to claim 1, wherein, in processing said second data file, associated finishing instructions are generated.

7. A method according to claim 6, wherein the generation of associated finishing instructions comprises determining franking values.

8. A method according to claim 6, wherein the generation of associated finishing instructions comprises selecting equipment for generating and finishing documents.

9. A method according to claim 6, wherein the generation of associated finishing instructions comprises determining imprints on envelopes in accordance with associated image defining instructions for printing documents.

10. A method according to claim 6, wherein the generation of associated finishing instructions comprises compiling transmittal data concerning a group of documents.

11. A method according to claim 1, wherein the processing of said second data file comprises verifying at least a portion of said driving instructions.

12. A method according to claim 1, wherein the processing of said second data file comprises processing at least a portion of said image defining instructions.

13. A method according to claim 12, wherein the processing of at least a portion of said image defining instructions comprises reading at least portions of said image defining instructions and sorting sets of said image defining instructions each associated with a particular document, in accordance with said portions read.

14. A method according to claim 1, wherein said instructions for processing said second data file into said processed second data file are inputted utilizing a universal interactive client server operating interface.

15. A method according to claim 14, wherein said interface comprises web browser software.

16. A method according to claim 14, wherein said second data file, at least prior to the processing, is free of finishing instructions.

17. A method according to claim 14, wherein said processed second data file comprises: a first subfile containing image defining instructions, a second subfile containing associated finishing instructions and reference instructions which couple said image defining instructions to associated ones of said finishing instructions.

18. A method according to claim 1, wherein the processing of said image defining instructions into said execution format comprises converting image defining instructions in a first printing apparatus language into image defining instructions in a second printing apparatus language.

19. A method according to claim 1, wherein said image defining instructions comprise at least two separately executable sets of image defining instructions each comprising image defining instructions for printing an individual page.

20. A method according to claim 1, wherein a plurality of documents including electronic and physical documents are generated.

21. A system for generating and finishing documents, comprising a data processor structure and equipment for generating and finishing documents, said data processor structure being arranged for:

converting a first data file in a first format for describing the content of at least one document, into a second data file in a second format, comprising image defining instructions and other instructions for finishing said at least one document; and processing said second data file into a processed second data file, wherein said image defining instructions are processed into driving instructions for generating at least one document and wherein said other instructions for finishing said at least one document are processed into driving instructions for finishing said at least one document;

wherein said data processor structure and said equipment for generating and finishing documents are operatively connected for driving said equipment for generating and finishing documents in accordance with driving instructions from said processed second data file; and wherein said equipment for generating and finishing documents is arranged for generating and finishing documents in accordance with said driving instructions;

wherein said data processor structure comprises a first data processor station and a second data processor station, which data processor stations are mutually coupled for transferring data from said first data processor station to said second data processor station;

wherein said first data processor station is arranged for providing a first data file in at least one first format, for describing the content of documents; for converting said first data file in said first format into said second data file in said second format; and for transferring said second data file to said second data processor station;

wherein said second data processor station is arranged for said processing of said second data file into a processed second data file and is operatively connected with said equipment for generating and finishing documents for driving said equipment.

22. A system according to claim 21, wherein said first data processor station is free of software adapted to said equipment for finishing documents.

23. A system according to claim 21, wherein said data processor structure is arranged for cooperation with web browser software, such that the processing of said second data file into driving instructions for generating documents and associated driving instructions for finishing documents is carried out in response to instructions inputted in cooperation with web browser software.

24. A system according to claim 21, wherein said equipment for generating and finishing documents comprises a printing apparatus an finishing equipment, which finishing equipment is arranged in-line with said printing apparatus, for finishing documents received directly from said printing apparatus.

25. A system according to claim 24, wherein said printing apparatus and said processing equipment each have a control unit of their own.

26. A system according to claim 25, wherein said control units each have a port of their own for communication with an external data processor.

27. A system according to claim 24, wherein said finishing equipment and said data processor structure are coupled and are arranged for transmitting processing capacity representing signals from said finishing equipment to said data processor structure and for driving said printing apparatus in response to said processing capacity representing signals, for printing at least one next document.

28. A system according to claim 21, wherein said equipment for generating and finishing documents comprises equipment for generating and finishing physical documents and equipment for generating and finishing electronic documents.

29. A computer program structure embodied on a computer readable medium, comprising:

instructions for converting a first data file in a first format for describing the content of at least one document into a second data file in a second format, comprising image defining instructions and other instructions for finishing said at least one document; and instructions for processing said second data file into a processed second data file, wherein said image defining instructions are processed into driving instructions for generating at least one document and wherein said other instructions for finishing said at least one document are processed into driving instructions for finishing said at least one document, wherein said driving instructions for generating at least one document comprise instructions for printing at least one document and which are adapted to be sent to a printing apparatus, wherein said driving instructions for finishing said at least one document comprise instructions for finishing a physical document printed by said printing apparatus and which are adapted to be sent, separately from said driving instructions for generating said at least one document, to a system for finishing physical documents.

* * * * *